US011174649B2

(12) United States Patent
Agoglia

(10) Patent No.: US 11,174,649 B2
(45) Date of Patent: Nov. 16, 2021

(54) REVEAL EDGE TILE CUTTING APPARATUS

(71) Applicant: Philip Agoglia, Freehold, NJ (US)

(72) Inventor: Philip Agoglia, Freehold, NJ (US)

( * ) Notice: Subject to any disclaimer, the term of this patent is extended or adjusted under 35 U.S.C. 154(b) by 555 days.

(21) Appl. No.: 15/284,873

(22) Filed: Oct. 4, 2016

(65) Prior Publication Data

US 2017/0096821 A1 Apr. 6, 2017

Related U.S. Application Data

(60) Provisional application No. 62/237,873, filed on Oct. 6, 2015.

(51) Int. Cl.

| | |
|---|---|
| ***E04F 21/00*** | (2006.01) |
| ***B26D 7/20*** | (2006.01) |
| ***B26D 11/00*** | (2006.01) |
| ***B26D 1/04*** | (2006.01) |
| ***B26F 1/38*** | (2006.01) |
| ***B26D 1/26*** | (2006.01) |
| ***B26D 7/26*** | (2006.01) |
| ***B26D 7/28*** | (2006.01) |

(52) U.S. Cl.

CPC ..... *E04F 21/0076* (2013.01); *B26D 1/045* (2013.01); *B26D 1/265* (2013.01); *B26D 7/20* (2013.01); *B26D 7/2628* (2013.01); *B26D 7/28* (2013.01); *B26D 11/00* (2013.01); *B26F 1/3846* (2013.01); *B26D 2011/005* (2013.01); *Y10T 83/8822* (2015.04); *Y10T 83/8831* (2015.04)

(58) Field of Classification Search

CPC ..... Y10T 83/8822; Y10T 83/7507; Y10T 83/0259; Y10T 83/8763; Y10T 83/8769; Y10T 83/0304; Y10T 83/02; B26F 1/3853; E04F 21/0076; B26D 3/06; B28D 1/225; B28D 1/226

USPC ..... 83/614; 30/300, 310

See application file for complete search history.

(56) References Cited

U.S. PATENT DOCUMENTS

| | | | | | |
|---|---|---|---|---|---|
| 1,511,016 | A | * | 10/1924 | Prescott | B28D 1/225 125/23.02 |
| 2,546,292 | A | * | 3/1951 | Bell | B23B 51/05 30/300 |
| 3,213,736 | A | * | 10/1965 | Keeton | B26F 1/3853 83/455 |
| 3,463,041 | A | * | 8/1969 | Perlmutter | G03D 15/04 83/564 |
| 3,515,019 | A | * | 6/1970 | Tyer, Jr. | B29C 53/063 409/304 |
| 3,924,496 | A | * | 12/1975 | DerMarderosian | B26D 3/006 409/288 |

(Continued)

FOREIGN PATENT DOCUMENTS

| | | | | | |
|---|---|---|---|---|---|
| DE | 10214758 | A1 | * | 10/2003 | B26B 5/005 |
| EP | 0826466 | A1 | * | 3/1998 | B26D 3/06 |

(Continued)

*Primary Examiner* — Laura M Lee

(74) *Attorney, Agent, or Firm* — Gearhart Law LLC

(57) ABSTRACT

A reveal edge tile cutting apparatus may have a tray with a top surface and a bottom surface, as well as a first set of tracks and a second set of tracks. Attached to these tracks is a vertical cutter featuring two cutting wheels, a horizontal cutter featuring a separate cutting wheel. A measuring device may be located on the top surface of the tray.

15 Claims, 3 Drawing Sheets

(56) References Cited

U.S. PATENT DOCUMENTS 4,231,275 A * 11/1980 Onishi ..... B26B 5/002 83/49
4,440,055 A * 4/1984 Gelfand ..... B26D 7/2614 83/529
4,548,105 A * 10/1985 Koutonen ..... B26D 7/2635 33/710
4,590,834 A * 5/1986 Sobel ..... B26D 3/02 83/455
4,631,997 A * 12/1986 Sobel ..... B26D 3/02 83/29
4,641,556 A * 2/1987 Vigneron ..... B26F 1/3853 83/36
4,656,910 A * 4/1987 Peterson ..... B26D 3/06 83/56
4,735,531 A * 4/1988 Boerckel ..... B23Q 1/621 144/136.95
4,777,724 A * 10/1988 Sirchia ..... B26B 5/005 30/287
4,895,483 A 1/1990 Anderson
4,951,539 A * 8/1990 Buckner ..... B26D 3/065 83/522.17
4,983,081 A * 1/1991 Cunningham, Jr. ... B26D 3/065 144/136.1
5,040,297 A * 8/1991 Scheinost ..... B26B 5/005 30/487
5,127,161 A * 7/1992 Ikeda ..... B43M 7/002 30/294
5,203,389 A * 4/1993 Goodwin ..... B27C 9/005 144/134.1
5,325,752 A * 7/1994 Bory ..... B26D 1/045 83/468.4
5,456,559 A 10/1995 Taylor
5,882,155 A * 3/1999 Testa, Jr. ..... B23D 61/003 144/136.95
5,996,237 A * 12/1999 Sanders ..... B26B 29/06 30/293
6,152,127 A 11/2000 Fuhrman et al.
6,612,036 B2 * 9/2003 Frazier ..... B26B 3/00 144/154.5
7,503,247 B2 * 3/2009 Cavanagh ..... B26D 1/035 83/563
7,798,287 B1 9/2010 Surace et al.
2003/0097758 A1 * 5/2003 Frazier ..... B26B 3/00 30/299
2003/0200663 A1 * 10/2003 Clanton ..... B26B 29/06 30/294
2010/0242290 A1 * 9/2010 Pugh ..... B28D 1/226 30/277.4
2011/0036219 A1 * 2/2011 Finnell ..... B26D 1/18 83/13
2012/0011977 A1 * 1/2012 Singer ..... B26D 1/185 83/471.2
2016/0052170 A1 * 2/2016 Moog ..... B28D 1/225 125/23.02
2017/0096821 A1 * 4/2017 Agoglia ..... B26D 1/045
2017/0175404 A1 * 6/2017 Marsiglia ..... E04F 21/0076

FOREIGN PATENT DOCUMENTS

EP 1424178 B1 5/2006
EP 1839789 A1 * 10/2007 ..... B23D 15/002
FR 2417373 A1 * 9/1979 ..... B28D 1/225
GB 435672 A 9/1935
GB 814840 A * 6/1959 ..... B27G 17/025
GB 2311485 A * 10/1997 ..... B28D 1/225
WO 2009008984 A1 1/2009

* cited by examiner

REVEAL EDGE TILE CUTTING APPARATUS

CLAIM OF PRIORITY

This application claims priority to U.S. Patent Application No. 62/237,873, entitled "REVEAL EDGE TILE CUTTING APPARATUS," filed on Oct. 6, 2015 the contents of which are herein incorporated by reference.

FIELD OF THE EMBODIMENTS

The field of the present invention and its embodiments relate to an apparatus for easily and consistently cutting tiles, in particular an apparatus for cutting reveal edges from acoustic tiles.

BACKGROUND OF THE EMBODIMENTS

Over the past 300 years, what man has done to create housing has varied dramatically. This is due to a number of factors such as advances in architecture and other technology, average family size, rises in living standards, the development of new heating and plumbing systems, and the availability and cost of various construction materials.

To this last consideration, the availability of new construction materials and the cost of extracting and preparing these materials has had a particularly large effect on the design of homes and other building alike. For example, the invention of concrete enabled the Romans to create a series of aqueducts, bringing water to remote regions never before contemplated by architects of the time. Similarly, the Eiffel tower was constructed to be as tall as it is due to the development of iron as a construction material. Consistent throughout these developments is the initial innovation showing that something can be used, and the subsequent innovation of reducing the cost of using that material, or increasing the speed and efficiency with which it can be used. However, this subsequent innovation can take some time to follow the initial innovation of discovering the material.

One such disparity in building construction materials pertains to drop ceilings and the acoustic tiles used to complete them. A drop ceiling is a "fake" ceiling that is located some distance below the "real" ceiling or some other component of the building's structure. This occurs when an architect wants the ceiling to appear to be lower than the ceiling the structure was built with. One such reason could be to have elaborate ductwork be hidden behind an aesthetically pleasing drop ceiling. These ceilings are typically constructing by having a metal framework "drop" some distance below another ceiling. The framework creates a lattice of sorts where tiles are dispersed to seal the gaps between the components of the lattice. Traditionally, the tiles will sit flushly with the lattice, creating a substantially flat ceiling.

However, as these substantially flat tiles became ubiquitous with commercial spaces, designers began to search for new ways to utilize the drop ceiling while creating a unique aesthetic appearance. One solution to this problem was to create a "reveal edge" tile. That is, a tile with a staggered edge such that part of the tile will be supported by the lattice of the drop ceiling, but the majority of the tile will dip below the lattice, creating a different impression.

With the advent of these reveal edge tiles, they rapidly grew in popularity, yet little innovation was used to make the creation of the tiles more convenient. While it was possible to purchase standard 24"×24" tiles with the reveal edge, anyone who has installed a drop ceiling will attest to the fact that in many situations, custom sized tiles need to be created to fit the ceiling. That said, a method or apparatus for customizing a reveal edge tile quickly has yet to be developed.

Review of Related Technology

U.S. Pat. No. 4,735,531 pertains to a router guide assembly which permits rectilinear movement of a router for cutting acoustic tile panels while providing a reveal edge along the cut edges. Quick and easy movement is provided by two railed carriage sub-assemblies, one of which is carried by the other. Manually activated mechanical stops are provided on each carriage for selectively preventing movement in either orthogonal direction so that a linear cut can be made in the other direction. Lock down devices are included for holding a tile in place. The assembly also includes a plastic housing and skirt attached to the underside of a router mounting plate for collecting and directing the sawdust resulting from the cutting of a tile to a location remote from the router guide assembly. Numerical measuring scales are selectively located on the assembly and include calibrations so that a required offset for bit size is automatically included when measuring for a particular cut.

U.S. Pat. No. 4,895,483 pertains to devices for resizing ceiling tiles and like panels with the simultaneous creation of a reveal edge thereon comprises a table unit having a quadrilateral, flat top work surface and a pair of spaced apart, parallel tubular guide members supported on the table unit above the work surface in a plane parallel thereto. The work surface has an elongated slot therein extending longitudinally between the guide members. There is a motor driven cutter unit comprising a depending rotary cutter element and a pair of lateral slide parts contoured to rest upon and slide longitudinally along the guide members supporting the cutter unit between the guide members with a portion of its cutter element extending into the work surface slot. The device additionally has a suction unit that includes a conduit with an inlet juxtaposed to the cutter element and above the work surface through which debris created by operation of the cutter unit is removed as the device is operated. Methods for resizing ceiling tiles and like panels with the simultaneous creation of a reveal edge thereon using such devices are disclosed.

U.S. Pat. No. 5,456,559 pertains to a cutting and beveling device for simultaneously cutting and beveling a selected work piece. The cutting and beveling device includes a work table and a support assembly secured to the work table. The work table defines a work surface for supporting the work piece. The support assembly supports a router in a manner such that the router is suspended over the work surface and is movable in a linear direction between the ends of the work table. The router receives a bit configured to cut and bevel simultaneously. The work table includes a slotted opening which receives shavings resulting from the cutting and beveling operation. The work table also includes a vacuum system for removing dust and particles resulting from the cutting and beveling operation.

U.S. Pat. No. 5,882,155 pertains to a ceiling tile cutting apparatus for the cutting and edging of successive tiles with corresponding angular cuts in a corresponding manner. The apparatus comprises a plurality of vertically arranged support legs connected by a plurality of horizontal members and a planar table member of generally rectilinear configuration attached at the upper end of the support legs. The table member has a first or proximal edge, a second or distal edge parallel to the first edge, a left hand edge and a right hand edge generally parallel to the left edge. An elongated slot extends through the table member parallel to the right hand edge of the table. A pair of guide rails supported over the elongated slot, and a motorized cutting tool mechanism is arranged to slide on the guide rails, with a cutting tool extending into the slot. An adjustable telescopable ruler is pivotably arranged on the table. The ruler has a first pivot axis location and a second pivot axis location to permit the adjustable ruler to guide tiles on the table from a plurality of base locations and allow tiles to be cut more efficiently.

U.S. Pat. No. 6,152,127 pertains to a frame assembly for a cutting apparatus includes a frame and a saw-motor mounting structure that is removably attachable to the frame. Therefore, a craftsperson can break down the frame assembly to allow easy transport of the cutting apparatus. Another apparatus includes a frame, motorized tool, item tray, and coolant pan. The frame has a coolant-pan slot, and the motorized tool is attachable to the frame. The item tray is movably mounted to the frame, and the coolant pan is slidably mounted within the coolant-pan slot. Therefore, a craftsperson can adjust the position of the coolant pan to catch coolant that dribbles off the item in the item tray. In addition, a cutting/routing apparatus includes a frame, a saw-motor mounting structure, a saw, a router mounting structure, a router, and a cutting/routing tray. The saw-motor mounting structure is attachable to the frame, and the saw is mountable to the saw-motor mounting structure. Likewise, the router mounting structure is attachable to the frame, and the router is mountable to the router mounting structure. The cutting/routing tray is movably mounted to the frame. Therefore, such an apparatus allows a craftsperson to cut and rout tiles on site with a single machine.

European Patent No.: 1424178 pertains to an apparatus for slicing materials into sheets, in particular slates or glass, of the type comprising at least one frame including a table defining a cutting slot traversed by a longitudinal blade mounted on a cut carriage guided above the gap and maneuvered by a handle input. This apparatus is characterized in that at least one component part of the frame, or coupled thereto, has an edge for cutting anvil.

British Patent No.: 435,672 pertains to a rotary cutter and pattern-tracing stylus have parallel axes, and the work and pattern are carried on a slide which may be moved universally in its plane by means of a manually operated power-multiplying lever. A platen secured to the table supports a lower slide movable radially of the pillar 1 and carrying an upper transversely movable slide on which the work wand pattern p are mounted.

International Patent Application No.: WO 2009/008984 pertains to a material shearing apparatus uses a horizontal receiver bar in support of a pair of spaced apart vertical guide rods having retainer blocks fixed in place on them, and a shearing head slidingly engaged with the guide rods so as to move between raised and lowered positions. A camshaft rotates eccentrically in the retainer blocks so as to bear on the shearing head which is thereby moved downwardly against return springs.

ToolPro®, Inc. creates a tool that is used for developing these customized reveal edges. It is a handheld tool that is run along the side of an edge-to-be-customized that utilizes the pointed edge of traditional razors. However, it suffers from alignment issues and from the rapid dulling of the blades used, due to the fact that such a small portion of the blade is used to make an incision.

Various systems and methodologies are known in the art. However, their structure and means of operation are substantially different from the present disclosure. The other inventions fail to solve all the problems taught by the present disclosure. The present invention and its embodiments take an approach for the rapid creation of reveal edge ceiling tile, in a manner that provides for decreased cost, increased portability, and increased productivity. At least one embodiment of this invention is presented in the drawings below and will be described in more detail herein.

SUMMARY OF THE EMBODIMENTS

The present invention provides for a tile cutting apparatus, comprising: a tray, having a top surface, a bottom surface, and a perimeter, a first set of tracks, wherein the first set of tracks extends beyond said perimeter; a first cutting mechanism, slidably connected to said first track, the first cutting mechanism comprising a first blade; a second cutting mechanism, slidably connected to said first track, the first cutting mechanism comprising a second blade and a third blade, wherein the second blade and third blade are in a oriented in a perpendicular position. In other embodiments, the present invention further comprises a pivoting handle connected to the first blade, wherein the handle allows the first blade to be rotated about an axis. In some embodiments, the present invention further comprises a measuring device disposed on said top surface. In a preferred embodiment, the present invention features a second set of tracks; and a hole cutting mechanism, comprising an adjustable circle cutter and a handle wherein said hole cutting mechanism is slidably attached to said second set of tracks, and wherein said adjustable circle cutter can be moved in a circular motion by said handle. Preferably, the first set of tracks and the second set of tracks are substantially parallel to each other. However, in other embodiments, the first set of tracks and the second set of tracks are substantially perpendicular to each other.

While the tray of the present invention is preferably sized to receive 24"×24" tiles, many other sizes are contemplated by the present invention. Further, the present invention is suitable for use with acoustical tiles, tiles with fiber class backing, veneer acoustical tiles, healthcare-compliant acoustical panels, sound panels, and insulation panels. In a highly preferred embodiment the first blade is sized to cut through a tile, and the second blade is sized to cut substantially halfway through said tile. In some embodiments the present invention features a tool storage area attached to said tray. Preferably, both the first set of tracks and the second set of tracks are elevated from the top surface, and more preferably they are elevated a distance of at least one inch. In a highly preferred embodiment, all of the blades of the present invention are replaceable.

The present invention also discloses a method of cutting a reveal edge on an acoustic tile. Preferably, this method comprises the steps of providing, a tile cutting apparatus, comprising: a tray, having a top surface, a bottom surface, and a perimeter, a first set of tracks, wherein the first set of tracks extends beyond said perimeter, a first cutting mechanism, slidably connected to said first track, the first cutting mechanism comprising a first blade, a second cutting mechanism, slidably connected to said first track, the first cutting mechanism comprising a second blade and a third blade, wherein the second blade and third blade are in a oriented in a perpendicular position; providing, at least one tile; placing, one of the at least one tiles on the tray; aligning, the placed tile with the perimeter of the tray such that it may be cut to a desired size; sliding, the first cutting mechanism, over an edge of the tile; sliding, the second cutting mechanism, over the edge of the tile such that a reveal edge is cut; removing, the placed tile from the tray. This method is also suitable for tiles with fiber class backing, veneer acoustical tiles, healthcare-compliant acoustical panels, sound panels, and insulation panels. In other embodiments of this method, the tile cutting apparatus further comprises: a second set of tracks; and a hole cutting mechanism, comprising an adjustable circle cutter and a handle wherein said hole cutting mechanism is slidably attached to said second set of tracks, and wherein said adjustable circle cutter can be moved in a circular motion by said handle; and the method further comprises the step of:

adjusting, the circle cutter to a desired radius; and rotating the handle until a circle is cut in the placed tile.

In general, the present invention succeeds in conferring the following, and others not mentioned, benefits and objectives:

It is an object of the present invention to reduce the cost of creating reveal edge tiles.

It is an object of the present invention to allow for unskilled workers to create customized reveal edge and standard edge tiles.

It is an object of the present invention to reduce the time needed to make customized reveal edge and standard edge tiles.

It is an object of the present invention to increase efficiency in making customized reveal edge and standard edge tiles.

It is an object of the present invention to improve the quality of hand-crafted reveal edge tiles.

DESCRIPTION OF THE PREFERRED EMBODIMENTS

Figure 1:
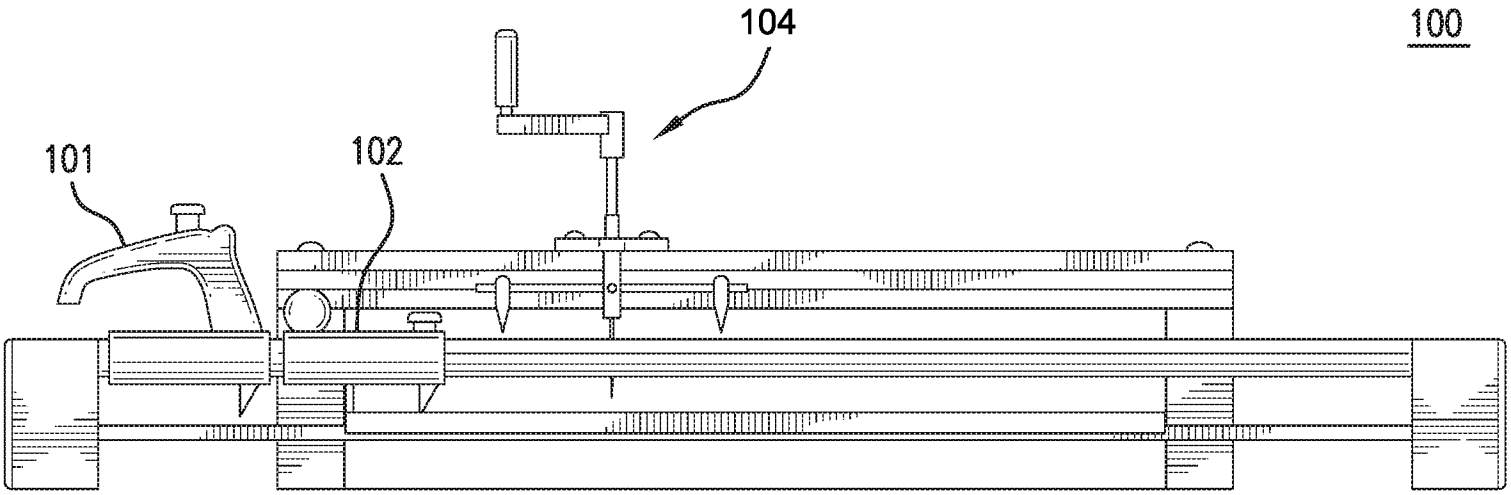
FIG. 1 shows a front view of an embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring to FIG. 1 a front view of an embodiment of the present invention in shown. Here, tile cutting apparatus 100 is comprised of first cutting mechanism 101, second cutting mechanism 102, and adjustable circle cutter 104. This view show the relationship between first cutting mechanism 101 and second cutting mechanism 102. First cutting mechanism 101 and second cutting mechanism 102 are on the same track. That is, when a user slides the second cutting mechanism 102 over a tile, when the first cutting mechanism 101 is slid along the same track, it will make cuts in substantially the same area, cutting a reveal edge for the tile. Circle cutter 104 is also shown.

Figure 2:
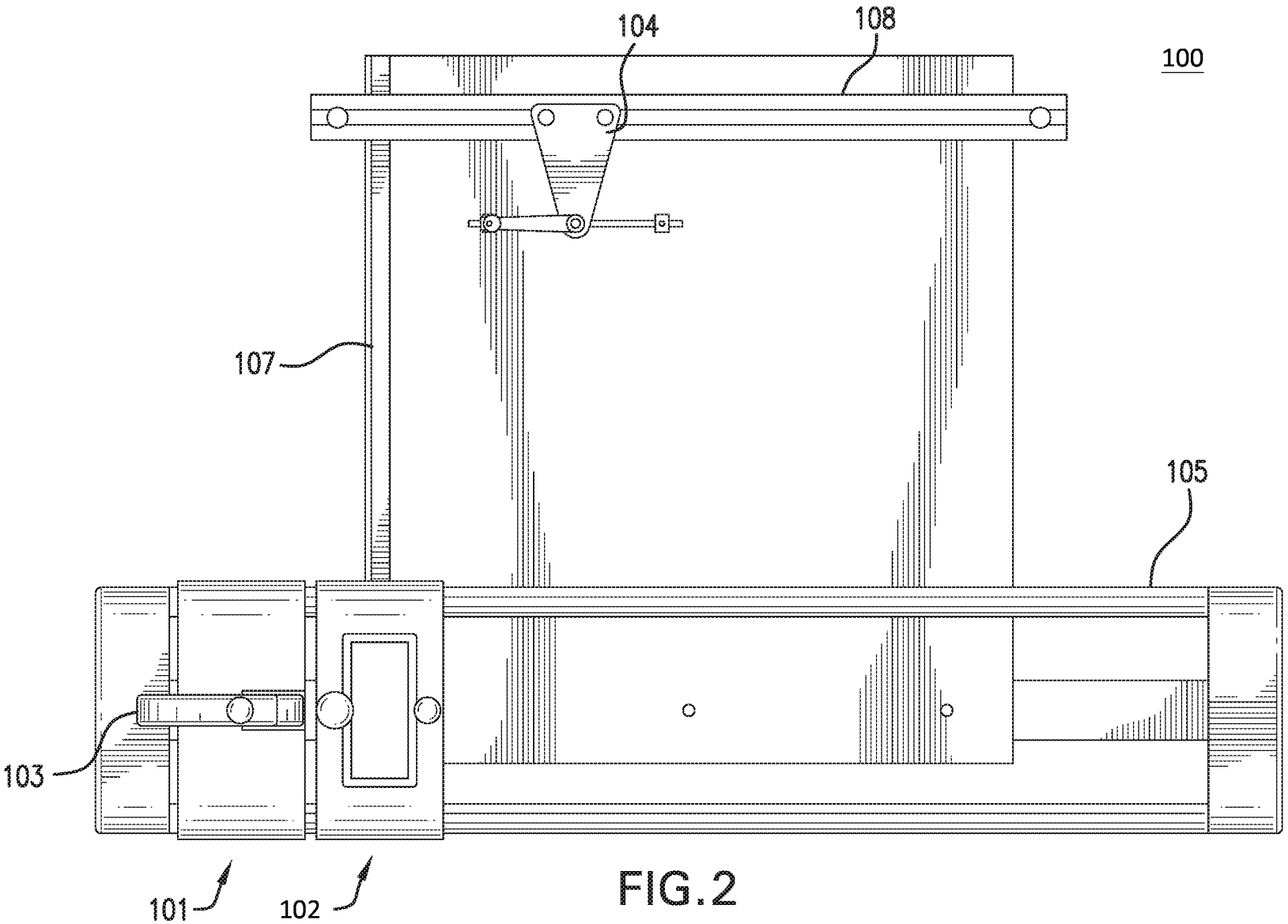
FIG. 2 shows a top view of an embodiment of the present invention.

FIG. 2 shows a top view of an embodiment of the present invention. Shown here is tile cutting apparatus 100, handle 103, adjustable circle cutter 104, measuring device 107, first set of tracks 105 and second set of tracks 108. As can be seen, first cutting mechanism 101 and second cutting mechanism 102 (See FIG. 1) are both disposed on first set of tracks 105. This allows them to provide consistent lines when cutting an inserted tile. Note that while the combination of these two cutting mechanisms can be used to create a reveal edge, by pivoting handle 103 such that the first cutting mechanism extends further downward, a user can cut a clean edge on an inserted tile. Measuring device 107 is disposed on the top surface of the tray so that a user may cut a tile to a specific size, which is often needed for acoustic tiles, as many ceiling are square-shaped. Preferable measuring device 107 is a ruler shown in inches, but it may also be shown in centimeters, or any other unit of distance. Second set of tracks 108 allows for adjustable circle cutter 104 to be positioned in an appropriate locations.

Figure 3:
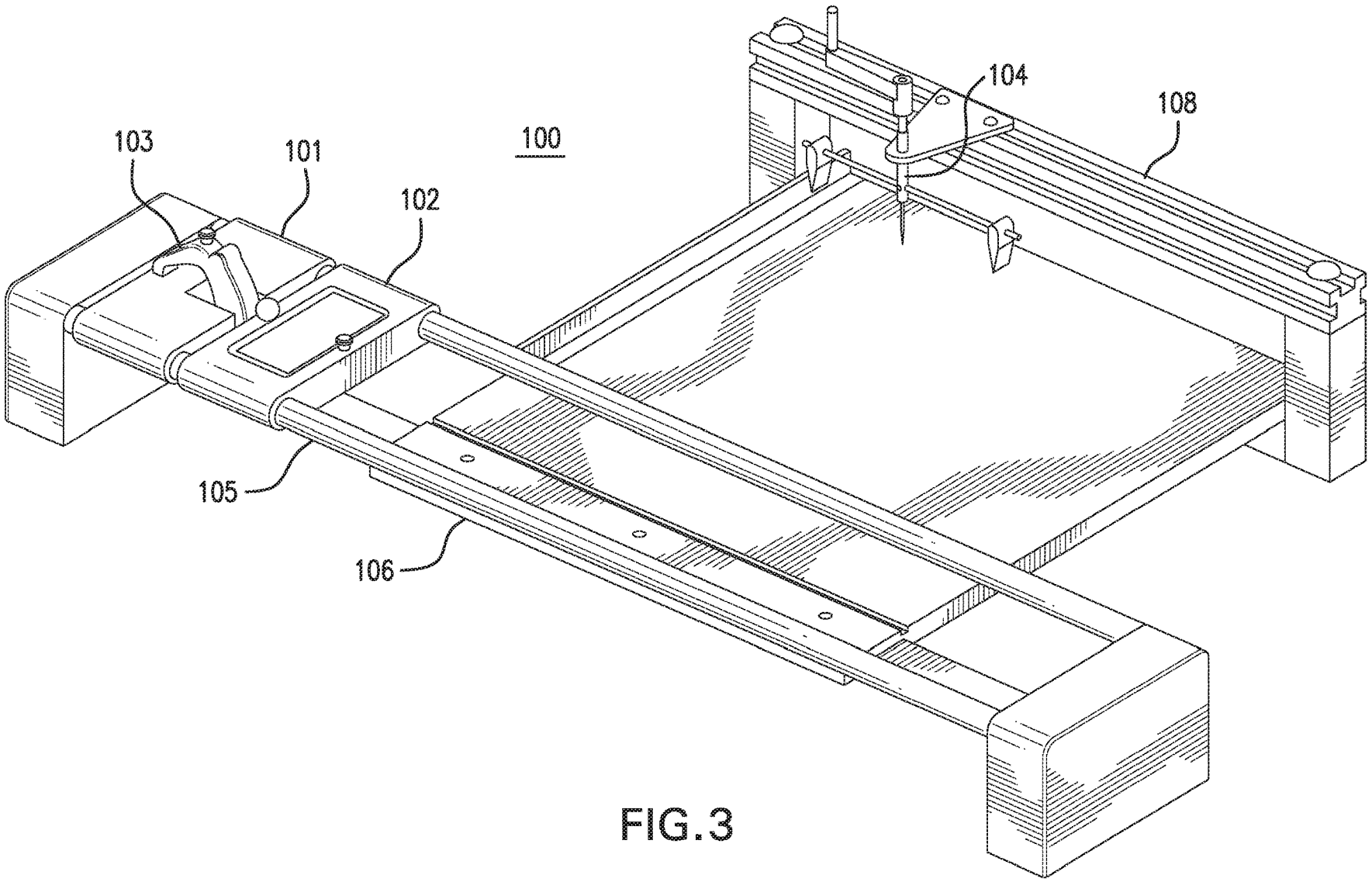
FIG. 3 shows a perspective view of an embodiment of the present invention.

Referring to FIG. 3, a perspective view of an embodiment of the present invention is shown. Of note here is cutting apparatus 100, first cutting mechanism 101, second cutting mechanism 102, adjustable circle cutter 104, first set of tracks 105, tray 106, and second set of tracks 108. A user would use this embodiment by placing a finished or unfinished tile on tray 106. After positioning the appropriate edge of the tile by first set of tracks 105, a user will slide second cutting mechanism 102 over the edge of the tile. This will completely cut the tile so that it is the appropriate shape. If a user merely wants to cut a tile they can remove it at this point. However, if a user wishes to create a reveal edge, they would slide the first cutting mechanism along first set of tracks 105. The dual blades of first cutting mechanism provide for the reveal edge. If a user wishes to cut a circle in the tile, to accommodate a sprinkler or other similar item, they position the portion of the tile to be cut underneath adjustable circle cutter 104. Note that adjustable circle cutter can slide on second set of tracks 108 to ease this process. Once in position, a user should calibrate adjustable circle cutter 104 so that it will create a circle with a desired diameter. At this point, a user would take the handle for adjustable circle cutter 104 and rotate the handle until the attached blades finish cutting the circle.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A tile cutting apparatus, comprising:

an elevated tray having a top surface, a bottom surface, and a perimeter, a first set of tracks held in an elevated position above the top surface of the elevated tray by a first support, the first set of tracks comprising a first cylindrical rod and a second cylindrical rod, wherein the elevated tray is elevated above a ground surface by the first support and a second support, wherein the first support is coupled to a first end of the elevated tray and the second support is coupled to a second end of the elevated tray, wherein the first set of tracks extends beyond said perimeter of said elevated tray, and wherein the first support comprises a first support member and a second support member separated by a distance greater than length of the elevated tray with each of the first cylindrical rod and the second cylindrical rod engaging and coupling to each of the first support member and the second support member, the first support member and the second support member elevate the tray in the elevated position above the ground surface; a first cutting mechanism comprising a first body and at least one blade, the first body being slidably connected to each of said first cylindrical rod and said second cylindrical rod of said first set of tracks, wherein the at least one blade extends downwardly from an underside of the first body;

a second cutting mechanism comprising a second body and at least two blades, the second body being slidably connected to each of the first cylindrical rod and the second cylindrical rod of said first set of tracks, wherein the at least two blades extend downwardly from an underside of the second body and are oriented perpendicularly to one another, and wherein the second cutting mechanism is positioned along the first set of tracks between the first cutting mechanism and a terminal end of the first set of tracks, wherein sliding of the first cutting mechanism and the second cutting mechanism along a length of the first set of tracks causes cutting of the tile in a direction parallel to a direction in which the first cutting mechanism and the second cutting mechanism is slid.

2. The tile cutting apparatus of claim 1, the first cutting mechanism further comprising a pivoting handle connected to the at least one blade, wherein the pivoting handle allows the at least one blade to be rotated about an axis.

3. The tile cutting apparatus of claim 1, further comprising a measuring device disposed on said top surface.

4. The tile cutting apparatus of claim 1, further comprising:

a second set of tracks; and a hole cutting mechanism, comprising an adjustable circle cutter and a handle wherein said hole cutting mechanism is slidably attached to said second set of tracks, and wherein said adjustable circle cutter is configured to be moved in a circular motion by said handle.

5. The tile cutting apparatus of claim 4, wherein the first set of tracks and the second set of tracks are substantially parallel to each other.

6. The tile cutting apparatus of claim 4, wherein the first set of tracks and the second set of tracks are substantially perpendicular to each other.

7. The tile cutting apparatus of claim 1, wherein said elevated tray is sized to receive a 24"×24" tile.

8. The tile cutting apparatus of claim 7, wherein the tile is selected from the group consisting of: acoustical tiles, tiles with fiber class backing, veneer acoustical tiles, healthcare-compliant acoustical panels, sound panels, and insulation panels.

9. The tile cutting apparatus of claim 7, wherein said at least one blade of the first cutting mechanism is sized to cut through the tile, and wherein one of said at least two blades of the second cutting mechanism is sized to cut substantially halfway through said tile.

10. The tile cutting apparatus of claim 1, wherein said first set of tracks and said second said of tracks are elevated a distance of 1 inch from said top surface.

11. The tile cutting apparatus of claim 1, wherein the at least one blade of the first cutting mechanism and the at least two blades of the second cutting mechanism are replaceable.

12. A tile cutting apparatus, comprising:

a tray having a top surface, a bottom surface, and a perimeter, wherein the tray is held in an elevated position above a ground surface by a first support and a second support;

a first set of tracks held in an elevated position above the top surface of the tray by the first support, the first set of tracks comprising a first cylindrical rod and a second cylindrical rod, wherein the first set of tracks extends beyond said perimeter of the tray and wherein the tray is coupled to and suspended in the elevated position by both a first support member and a second support member of the first support, wherein the first support is coupled to a first end of the elevated tray and the second support is coupled to a second end of the elevated tray; wherein each of the first cylindrical rod and the second cylindrical rod engage and couple to each of the first support member and the second support member;

a second set of tracks held in an elevated position above the top surface of the tray by the second support, wherein the second set of tracks are oriented parallel to the first set of tracks and separated from the first set of tracks by a distance, wherein the tray is coupled to and suspended in the elevated position by both a first support member and a second support member of the second support; and a first cutting mechanism comprising a first body and at least one blade, the first body being slidably connected to each of the first cylindrical rod and the second cylindrical rod of said first set of tracks, wherein the at least one blade extends downwardly from an underside of the first body; and wherein said first cutting mechanism is sized and positioned to extend and cut completely through a thickness of an acoustic tile;

a second cutting mechanism comprising a second body and at least two blades, the second body being slidably connected to each of the first cylindrical rod and the second cylindrical rod of said first set of tracks, wherein one of the at least two blades is sized and positioned to extend and cut at a distance less than that of the at least one blade of the first cutting mechanism, wherein the at least two blades extend from an underside of the second body and are oriented perpendicularly to one another, and wherein the second cutting mechanism is positioned along the first set of tracks between the first cutting mechanism and a terminal end of the first set of tracks such that the first cutting mechanism is configured to be slid along the first set of tracks before the second cutting mechanism can be slid along the first set of tracks in a cutting direction, and wherein sliding of the first cutting mechanism and the second cutting mechanism along a length of the first set of tracks causes cutting of the acoustic tile in a direction parallel to a direction in which the first cutting mechanism and the second cutting mechanism is slid.

13. The tile cutting apparatus of claim 12 wherein the first support is coupled to the first set of tracks and the second support is coupled to a second set of tracks.

14. The tile cutting apparatus of claim 12 wherein the first body and the second body each have two cylindrical apertures extending from a first side to a second side of the first body and the second body, the two cylindrical apertures configured to independently receive the first cylindrical rod and second cylindrical rod therethrough.

15. The tile cutting apparatus of claim 12 wherein the first set of tracks span the distance between the first and second support members of the first support.

* * * * *